US009623880B1

(12) United States Patent
Kun

(10) Patent No.: US 9,623,880 B1
(45) Date of Patent: Apr. 18, 2017

(54) METHOD AND APPARATUS FOR RAIL-TO-ROAD SHIPPING

(71) Applicant: SEA-TRAIN EXPRESS - LLC, Federal Way, WA (US)

(72) Inventor: David Kun, Federal Way, WA (US)

(73) Assignee: SEA-TRAIN EXPRESS - LLC, Federal Way, WA (US)

( * ) Notice: Subject to any disclaimer, the term of this patent is extended or adjusted under 35 U.S.C. 154(b) by 0 days.

(21) Appl. No.: 15/145,724

(22) Filed: May 3, 2016

(51) Int. Cl.
*B61C 11/00* (2006.01)
*B61C 7/00* (2006.01)

(52) U.S. Cl.
CPC ..... *B61C 11/005* (2013.01); *B61C 7/00* (2013.01)

(58) Field of Classification Search
CPC ..... B61C 11/00; B61C 11/005; B61C 11/02; B61C 11/04; B60F 1/00; B60F 1/04; B60F 5/00
See application file for complete search history.

(56) References Cited

U.S. PATENT DOCUMENTS

| | | | | |
|---|---|---|---|---|
| 1,858,769 | A | 5/1932 | Erskine | |
| 1,980,664 | A | 11/1934 | Burrows et al. | |
| 2,267,338 | A | 12/1941 | Nugent | |
| 2,862,458 | A | 12/1958 | Lewis | |
| 2,963,986 | A | 12/1960 | Dobson | |
| 3,154,023 | A | 10/1964 | Karlet et al. | |
| 3,756,159 | A | 9/1973 | Sterad | |
| 4,048,925 | A | 9/1977 | Storm | |
| 4,669,391 | A | 6/1987 | Wicks et al. | |
| 4,733,617 | A | 3/1988 | Boeniger | |
| 4,907,514 | A | 3/1990 | Wicks et al. | |
| 5,537,931 | A | 7/1996 | Donkin | |
| 6,101,953 | A * | 8/2000 | Spata | B61C 11/005 105/215.1 |
| 6,109,845 | A | 8/2000 | Kerr | |
| 6,123,029 | A | 9/2000 | Mobley | |
| 8,061,277 | B2 | 11/2011 | Jacob | |

* cited by examiner

*Primary Examiner* — R. J. McCarry, Jr.
(74) *Attorney, Agent, or Firm* — R. Reams Goodloe, Jr.

(57) ABSTRACT

A power system for short trains. In an embodiment, an over-the-road tractor is configured with drive gears on a drive axle to interface with driven gear systems on a rail car. By utilizing the apparatus, a method for efficient delivery of goods in containers on semi-trailers may be achieved, thus saving considerable time, and reducing costs.

16 Claims, 3 Drawing Sheets

METHOD AND APPARATUS FOR RAIL-TO-ROAD SHIPPING

RELATED PATENT APPLICATIONS

None.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This application relates to systems for providing delivery of semi-trailers and trailers involving local railroad operations, followed by transfer to roads for local trucking deliveries, and to apparatus which may be employed to facilitate such delivery and transfer.

BACKGROUND

In the freight shipping business, it is well known that in many situations, the last few miles are both the source of delays and of extra costs, as may be required for special handling of small quantities of goods by rail to remote locations. However, since the delivery often involves the rail transfer of highway capable trailers to locations near final destinations, subsequent connection with trucks is a rather labor intensive and time consuming activity.

As a result, the use of rail-to-road intermodal system methods have largely been limited to long distance freight hauls. However, in an ever more competitive shipping cost environment, there remains a need for improvements which would provide cost savings, and in particular, labor hour savings, especially for the last few miles required for delivery of goods. Thus, it would be advantageous if novel, cost effective methods were available, along with novel apparatus for implementation of such methods, for improving economics of ship-to-rail-to-road freight transfer.

BRIEF DESCRIPTION OF THE DRAWING FIGURES

The present invention will be described by way of exemplary embodiments, illustrated in the accompanying drawing figures in which like reference numerals denote like elements, and in which.

Figure 4:
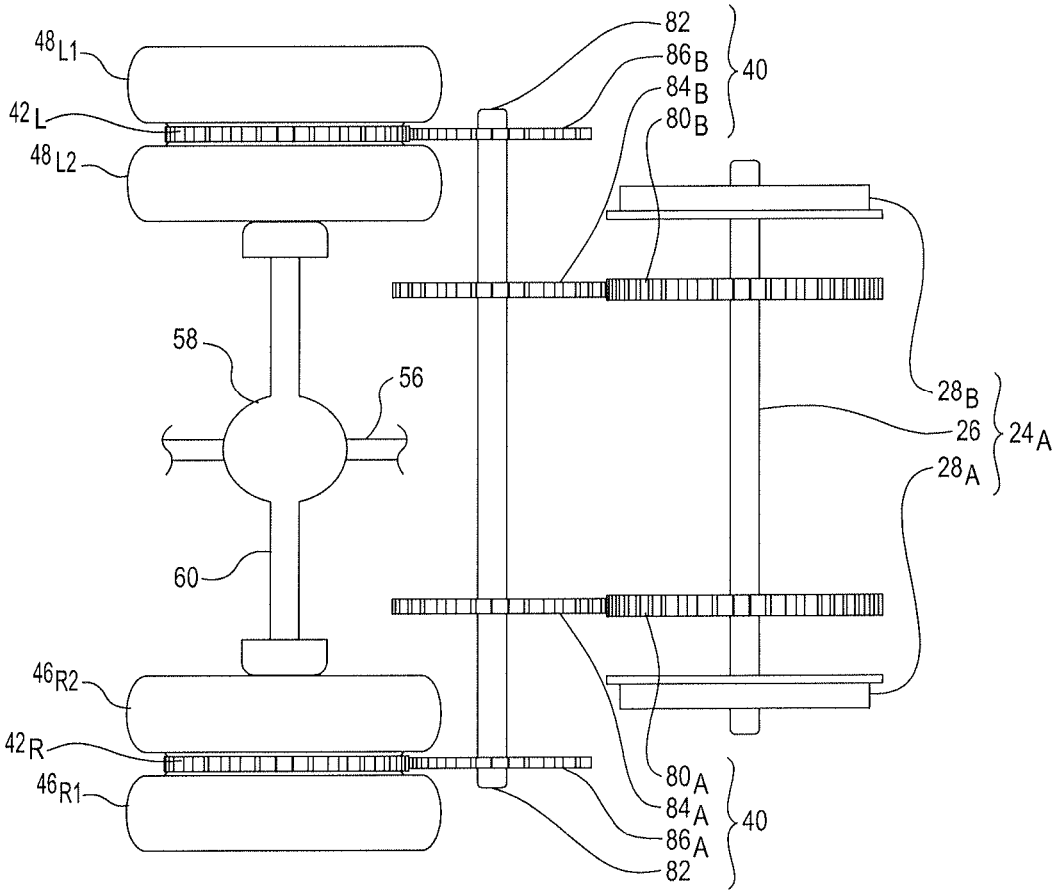

FIG. 4 provides an diagrammatic representation to show a first gear drive system useful of an embodiment of a rail car with gearing adapted to receive power from an over-the-road tractor with a driving gear between dual tires.

The foregoing figures, being merely exemplary, contain various elements that may be present or omitted from a specific embodiment for an apparatus as taught herein. The figures have been provided in a way that illustrates at least those elements that are significant for an understanding of the apparatus and methods taught herein, and for the alternate configurations thereof. However, various other elements for gear system useful for driving a rail car, and intermodal freight system components and methods of use thereof, may be utilized, within the teachings hereof and within the coverage of the claims set forth herein.

DETAILED DESCRIPTION

Unique equipment and methods for use in ship-rail-road intermodal freight systems are set forth herein. Some of the equipment useful in carrying out the method(s) described herein was previously described in U.S. Pat. No. 8,800,452 B2, issued Aug. 12, 2104, to David KUN, and entitled Railroad Freight Car Loading or Unloading, and in U.S. patent application Ser. No. 15/144,517, entitled Method and Apparatus for Intermodal Container Handling, filed on May 2, 2016, the disclosures of each of which are incorporated herein in their entirety by this reference. The illustrations provided in this disclosure are directed at embodiments utilizing the most common tractor design configurations for over the road use in North America, namely, for pulling a semi-trailer. By definition, a semi-trailer is a trailer without a front axle. In semi-trailers, a large proportion of the weight in the semi-trailer is supported by an over-the-road tractor. Over-the-road tractors are generally equipped with large diesel engines and may be available, with drive modifications, to provide adequate power for short train rail operations.

Figure 1:
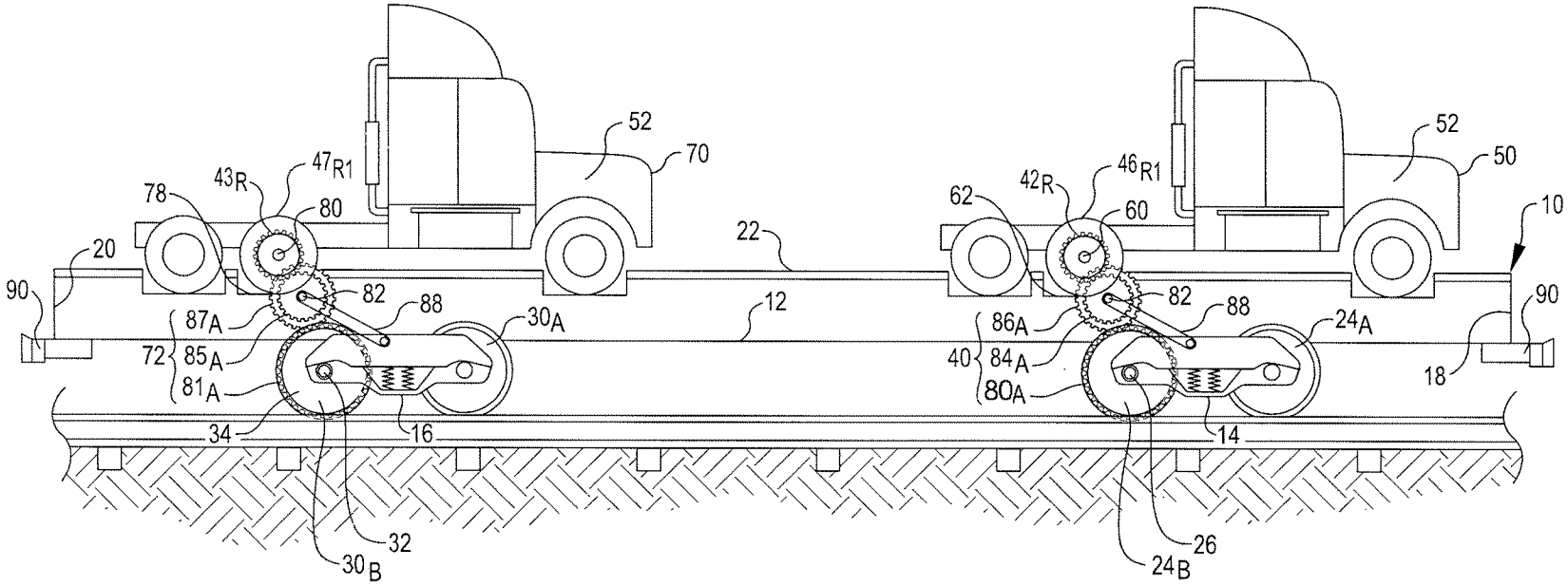
FIG. 1 shows a partially cut away side elevation view of a flatbed rail car which has been developed to support one or more over-the-road tractors (the type adapted for pulling semi-trailers), wherein the tractors are additionally provided with driving gears adapted to interface with driven gears provided on a bogie supporting the rail car.

Attention is directed to FIG. 1, where an apparatus for powering short trains on rail is depicted. In an embodiment, the apparatus includes a rail car 10, which has a frame 12 supported by a first bogie 14 and a second bogie 16. The frame 12 has a front 18, a rear 20, and a deck 22. The first bogie 14 may include two wheel sets 24A and 24B, one of which includes a first rail axle 26 and a first pair of flanged main rail wheels $\mathbf{28}_A$ and $\mathbf{28}_B$ located on opposing sides of the first rail axle 26. As illustrated in FIG. 1, the first bogie 14 is located at or near the front 18 of the frame 12. The second bogie 16 may also include two wheel sets $\mathbf{30}_A$ and $\mathbf{30}_B$, one of which includes a second rail axle 32 and a second pair of flanged main rail wheels 34 (similar to first pair of flanged main wheels $\mathbf{28}_A$ and 28B illustrated in FIG. 4) located on opposing sides of second rail axle 32. As illustrated in FIG. 1, the second bogie 16 is located at or near the rear 20 of the frame 12.

As also seen in FIG. 1, a first gear system 40 is provided. The first gear system 40 includes a plurality of gears (see FIG. 4 and as further described below) configured to receive motive power supplied from one or more external rail driving gears, such as external rail driving gears $\mathbf{42}_R$ and $42_L$, located respectively between dual right wheels $46_{R1}$ and $46_{R2}$, and dual left wheels $48_{L1}$ and $48_{L2}$ on a first over-the-road tractor 50. In an embodiment, the one or more external rail driving gear $42_R$ and $42_L$ are located in an elevated position (e.g., vertically above but may be longitudinally displaced rearwardly) above the first pair of flanged main rail wheels $28_A$ and $28_B$.

Figure 2:
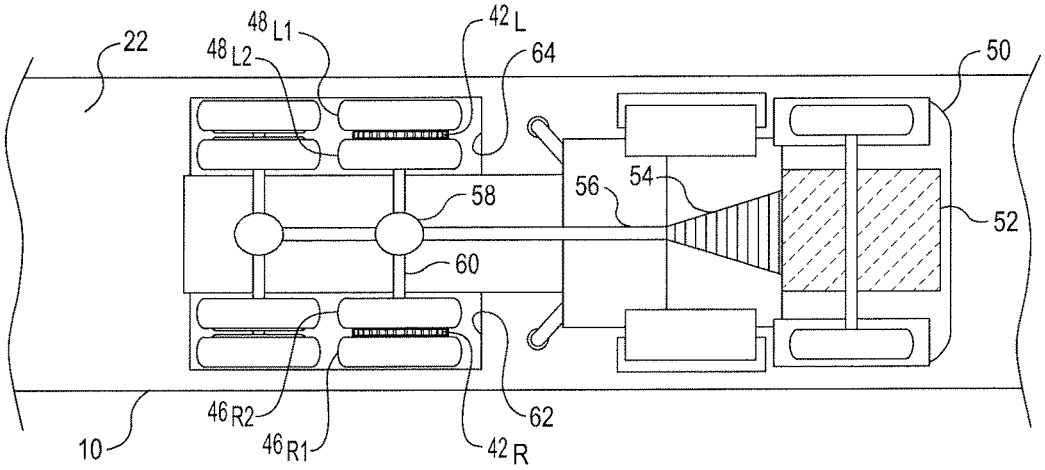
FIG. 2 shows yet further details for an embodiment of an over-the-road tractor which has been adapted for use in propulsion of train cars, showing that in an embodiment, drive gears may be located between a set of dual wheels on opposing sides of a first axle, and that a tandem axle arrangement may be used.
Figure 3:
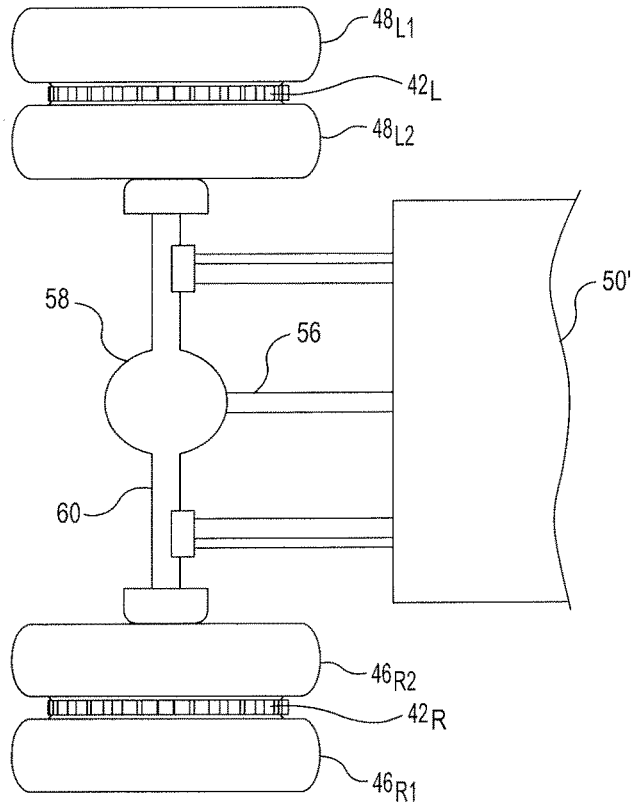
FIG. 3 depicts a plan view of a single rear axle tractor having a driving gears located between each set of dual wheels; the tractor and gears (see FIGS. 1 and 4) are suitable for driving trains for local delivery of goods.

As seen in FIG. 2, in an embodiment, the first over-the-road tractor 50 may include an engine 52 and a transmission 54, connected in conventional fashion via driveline 56 and differential 58 to a first drive axle 60. Attached to the first drive axle 60 are first and second sets of dual wheels ($46_{R1}$ and $46_{R2}$ on the right, and $48_{L1}$ and $48_{L2}$ on the left) on opposing sides of the first drive axle 60. As just noted above, the first external rail driving gear $42_R$ may be disposed between the first set of dual wheels $46_{R1}$ and $46_{R1}$ and may be recessed sufficiently that the first external rail driving gear $42_R$ substantially avoids ground contact during highway operations. A second external rail driving gear $42_L$ may be disposed between a second set of dual wheels $48_{L1}$ and $48_{L2}$ and recessed sufficiently (i.e., of a sufficiently small outside diameter) that the second external rail driving gear $42_L$ substantially avoids ground contact during highway operations.

In an embodiment, as can be visualized from FIG. 1 or 2, the deck 22 includes apertures therein (e.g. as defined by sidewalls 62, on the right, and 64, on the left) sized and shaped to accommodate therethrough the first and second sets of dual wheels ($46_{R1}$ and $46_{R2}$ on the right, and $48_{L1}$ and $48_{L2}$ on the left), so that when said first over-the-road tractor 50 is placed on the deck 22, the first and second external rail driving gears $42_R$ and $42_L$ are located in meshing engagement with first gear system 40 for supply of motive power thereto from the engine 52 of the first over-the-road tractor 50.

As seen in FIG. 1, in an embodiment, a second over-the-road tractor 70 may be provided. The second over-the-road tractor 70 may include essentially identical components as the first-over-the road tractor 50. Such components may include an engine 52, and a transmission 54, connected in conventional fashion via a driveline 56 and differential 58 to a second drive axle 80 (some just mentioned components of second over-the-road tractor 70 are not illustrated in the drawing figures but may be provided in a configuration substantially the same as earlier identified by identical reference numeral in connection with first over-the-road tractor 50).

Attached to second drive axle 80 of second over-the-road tractor 70 are third and fourth sets of dual wheels (substantially the same as depicted in FIGS. 2 and 4 for first and second sets of dual wheels $46_{R1}$ and $46_{R2}$ on the right, and $48_{L1}$ and $48_{L2}$ on the left) on opposing sides of the second drive axle 80. Similar to the configuration just noted above for first over-the-road tractor 50, in the case of a second over-the-road tractor 70, a third external rail driving gear $43_R$ may be disposed between the third set of dual wheels $47_{R1}$ and $47_{R2}$ and may be recessed sufficiently that the third external rail driving gear $43_R$ substantially avoids ground contact during highway operations. A fourth external rail driving gear $43_L$ (not illustrated but substantially similar to that provided for external rail driving gear $42_R$ shown in FIG. 2) may be disposed between a fourth set of dual wheels $49_{L1}$ and $49_{L2}$ (again, not illustrated but substantially similar to that provided for of dual wheels $48_{L1}$ and $48_{L2}$ shown in FIG. 2) and recessed sufficiently (i.e., of a sufficiently small outside diameter) that the fourth external rail driving gear $43_L$ substantially avoids ground contact during highway operations.

In an embodiment, as can be visualized from FIG. 1 or 2, the deck 22 includes apertures therein (e.g. as defined by sidewalls 78 (on the right, and 84, on the left but not shown) sized and shaped to accommodate therethrough the first and second sets of dual wheels ($47_{R1}$ and $47_{R2}$ on the right, and $49_{L1}$ and $49_{L2}$ on the left), so that when the second over-the-road tractor 70 is placed on the deck 22 of rail car 10, the third and fourth external rail driving gears $43_R$ and $43_L$ are located in meshing engagement with a second gear system 72 for supply of motive power thereto from engine 52 of the second over-the-road tractor 70.

Attention is directed to FIG. 4, where a first gear system 40 is schematically and functionally depicted (for ease of understanding, the components appear spread out longitudinally, as compared to the arrangement depicted in the embodiment illustrated in FIG. 1). A first gear system 40 for receiving power from an external rail drive power source such as over-the-road tractor 50 is provided. The first gear system 40 is configured for receiving power via external rail driving gears $42_R$ and $42_L$, and transmitting power from the power source (tractor 50) to a first rail axle 26 mounted on the first bogie 14. The first gear system 40 includes a first gear set 80 (which may in an embodiment include at least two gears $80_A$ and $80_B$) mounted on the first rail axle 26. A first floating shaft 82 is provided having a second gear set 84 which may in an embodiment include at least two gears $84_A$ and $84_B$ and a third gear set 86 (which may in an embodiment include at least two gears $86_A$ and $86_B$) mounted thereon. As seen in FIG. 1, the first floating shaft 82 may be pivotably mounted by arms 88 to the first bogie 14. The first floating shaft 82 provides a pivotable connection to first bogie 14 which allows said the first gear set 80 to connect with the second gear set 84 while allowing relative movement of the first gear set 80 with respect to the second gear set 84, as well as allowing vertical movement of the deck 22 of the rail car with respect to the first rail axle 26. The second gear set $84_A$ and $84_B$ is disposed in meshing engagement with the first gear set $80_A$ and $80_B$ and is adapted to drive the first gear set $80_A$ and $80_B$ in response to power applied to the first floating shaft 82 as received by the third gear set $86_A$ and $86_B$. In this embodiment, the first rail axle 26 drives rail car 10 in response to power applied by tractor 50 to the third gear set $86_A$ and $86_B$.

Returning now to FIG. 1, a second over-the-road tractor 70 may be provided to supply power from engine 52 to rail car 10 via a second gear system 72. The second gear system 72 is configured for receiving power via external rail driving gears $43_R$ and $43_L$, and transmitting power from the power source, tractor 50, to a second rail axle 32 mounted on the second bogie 16. The second gear system 72 includes a fourth gear set 81 (which may in an embodiment include at least two gears $80_A$ and $80_B$) mounted on the second rail axle 32. A second floating shaft 83 having a fifth gear set 85 which may in an embodiment include at least two gears $85_A$ and $85_B$ and a sixth gear set 87 (which may in an embodiment include at least two gears $87_A$ and $87_B$) mounted thereon is provided. As seen in FIG. 1, the second floating shaft 83 may be pivotably mounted by arms 88 to the second bogie 16. The fifth gear set 85 (which may include at least two gears $85_A$ and $85_B$) is disposed in meshing engagement with the fourth gear set 81 (which may include at least two gears $81_A$ and $81_B$) and is adapted to drive the fourth gear set $81_A$ and $81_B$ in response to power applied to the second floating shaft 83 as received by the sixth gear set 87 (which may include at least two gears $87_A$ and $87_B$). It will be understood by those of skill in the art and to which this specification is directed that even though only an operational schematic is provided in the elevation view of FIG. 1, the various gear sets (81, 85, 87) mentioned in this paragraph may be provided in at least two gears in the same manner as was depicted for the companion first gear system 40 which was illustrated in FIG. 4. In any event, in this embodiment, the second rail axle 32 drives rail car 10 in response to power applied by second truck 70 to the sixth gear set $87_A$ and $87_B$.

In practice, the apparatus described herein may be utilized in a method for intermodal transport of goods by rail, where over-the-road trailers are utilized. In such methods, the rail car 10 may be employed to pull via coupling 90 one or more freight cars FC (not shown but for example may be as described in the patent or patent application referenced above). Freight cars FC are adapted for carriage of semi-trailers or trailers, for example, may be configured for over-the-road transport of shipping containers, when the shipping containers are mounted on a conventional over-the-road chassis. This in the instant method, the over-the-road tractors 50 or 70 may be unloaded from the rail car 10 by conventional means and then utilized at a specified end-of-rail destination for carriage of the over-the-road trailers to the final destination for the goods being transported. In a further refinement of the method, the freight cars FC may be configured to carry over-the-road trailers, and the over-the-road trailers may be organized by specified final destination and placed on said one or more freight cars FC. Then, the over-the-road trailers may be removed from the freight cars FC at specified destination end-or-rail yard. Subsequently, the over-the-road tractor 50 or 70 delivers over-the-road trailers to a specified final destination.

In the foregoing description, numerous details have been set forth in order to provide a thorough understanding of the disclosed exemplary embodiments for apparatus and method for driving short trains with over-the-road tractors, and to methods of their use in rail-road intermodal freight systems. However, certain of the described details may not be required in order to provide useful embodiments, or to practice selected or other disclosed embodiments. Further, the description may include, for descriptive purposes, various relative terms such as surface, at, adjacent, proximity, near, on, onto, and the like. Such usage should not be construed as limiting. Terms that are relative only to a point of reference are not meant to be interpreted as absolute limitations, but are instead included in the foregoing description to facilitate understanding of the various aspects of the disclosed embodiments. Various components are described which may be employed alternatively, yet be included in some designs or components for use in a particular situation. Accordingly, the method(s) described herein may be utilized in whole or in part in various discrete operations, in a manner that is most helpful in a particular circumstance. However, the order of description should not be construed as to imply that such alternatives are necessarily order dependent, or that use of various components is necessarily in the alternative. Also, the reader will note that the phrase "in one embodiment" has been used repeatedly. This phrase generally does not refer to the same embodiment; however, it may. Finally, the terms "comprising", "having" and "including" should be considered synonymous, unless the context dictates otherwise.

Various aspects and embodiments described and claimed herein may be modified from those shown without materially departing from the novel teachings and advantages provided by this invention, and may be embodied in other specific forms without departing from the spirit or essential characteristics thereof. Embodiments presented herein are to be considered in all respects as illustrative and not restrictive or limiting. This disclosure is intended to cover methods and apparatus described herein, and not only structural equivalents thereof, but also equivalent structures. Modifications and variations are possible in light of the above teachings. Therefore, the protection afforded to this invention should be limited only by the claims set forth herein, and the legal equivalents thereof.

The invention claimed is:

1. Apparatus for powering short trains on rails, said apparatus comprising:

(a) a rail car, said rail car comprising a frame, said frame having a front, a rear, and a deck, said frame supported by a first bogie and by a second bogie, said first bogie having a first rail axle and a first pair of flanged main rail wheels located on opposing sides of said first rail axle, said first bogie located at or near the front of said frame, said second bogie having a second rail axle and a second pair of flanged main rail wheels located on opposing sides of said second rail axle, said second bogie located at or near the rear of said frame;

a first gear system, said first gear system comprising a plurality of gears configured to receive motive power supplied from one or more external rail driving gears, and wherein said one or more external driving gears are located above said first pair of flanged main rail wheels;

(b) a first over-the-road tractor, said first over-the-road tractor comprising an engine, a transmission, a first drive axle, said first drive axle further comprising first and second sets of dual wheels on opposing sides of said first drive axle;

first and second external rail driving gears, said first external rail driving gear disposed between said first set of dual wheels and recessed sufficiently that said first external rail driving gear avoids ground contact during highway operations, and said second external rail driving gear disposed between said second set of dual wheels and recessed sufficiently that said second rail driving gear avoids ground contact during highway operations; and (c) wherein said deck includes apertures therein sized and shaped to accommodate therethrough said first and second sets of dual wheels, so that said when said first over-the-road tractor is placed on said deck, said first and second external rail driving gears are located in meshing engagement with said a first gear system for supply of motive power thereto from said engine of said first over-the-road tractor.

2. The apparatus as set forth in claim 1, wherein said apparatus further comprises a second over-the-road tractor, said second over-the-road tractor comprising an engine, a transmission, a second drive axle, said second drive axle configured for propelling third and fourth sets of dual wheels on opposing sides of said second drive axle, and third and fourth external rail driving gears, said third external rail driving gear disposed between said third set of dual wheels and recessed sufficiently that said third external rail driving gear avoids ground contact during highway operations, and said fourth external rail driving gear disposed between said fourth set of dual wheels and recessed sufficiently that said fourth rail driving gear avoids ground contact during highway operations;

wherein said rail car further comprises a second gear system, said second gear system comprising a plurality of gears configured to receive motive power supplied from third and fourth external rail driving gears on said second over-the-road tractor, and wherein said one or more external rail driving gears are located above said second pair of flanged main rail wheels; and wherein said deck includes apertures therein sized and shaped to accommodate therethrough said third and fourth sets of dual wheels, so that when said over-the-road tractor is placed on said deck, said third and fourth external rail driving gears are located in meshing engagement with said second gear system for supply of motive power thereto from said second over-the-road tractor engine.

3. Apparatus for driving a rail car, said apparatus adapted to receive power from an external power source having an external driving gear, said apparatus comprising:

a frame, said frame having a front, a rear, and a deck, said frame supported by a first bogie and by a second bogie, said first bogie having a first rail axle and a first pair of flanged main rail wheels located on opposing sides of said first rail axle, said first bogie located at or near the front of said frame, said second bogie having a second rail axle and a second pair of flanged main rail wheels located on opposing sides of said second rail axle, said second bogie located at or near the rear of said frame;

a first gear system for intermeshing engagement with external rail driving gears on an external power source, so as to receive power from the external power source via the external rail driving gears, and transmitting power from the external power source to said first rail axle mounted on the first bogie, said first gear system including a first gear set mounted on said first rail axle, a first floating shaft having a second gear set and a third gear set mounted thereon, said first floating shaft pivotably mounted to said first bogie, and said third gear set comprising gears adapted for intermeshing engagement with external rail driving gears on an external power source;

said second gear set disposed in meshing engagement with said first gear set and adapted to drive said first gear set in response to power applied to said first floating shaft as received by said third gear set, so that said first rail axle drives said rail car in response to power applied to said third gear set.

4. Apparatus as set forth in claim 3, wherein said first gear set on said first rail axle on said first bogie comprises at least two driven gears.

5. Apparatus as set forth in claim 3, wherein said second gear set on said first floating shaft comprises two driving gears, and wherein said first gear set and said second gear set are configured for meshing engagement.

6. Apparatus as set forth in claim 3, wherein said third gear set on said first floating shaft comprises two gears, and wherein said third gear set is configured to receive power and drive said first floating shaft and said second gear set.

7. Apparatus for driving a railway car, as set forth in claim 3, further comprising:

a second gear system for intermeshing engagement with external rail driving gears on an external power source, so as to receive power from the external power source via external rail driving gears, and transmitting power from the external power source to a second rail axle mounted on the second bogie, said second gear system including a fourth gear set mounted on said second rail axle, a second floating shaft having a fifth gear set and a sixth gear set mounted thereon, said second floating shaft pivotally mounted to said second bogie, and said sixth gear set comprising gears adapted for intermeshing engagement with external rail driving gears on an external power source;

said fifth gear set disposed in meshing engagement with said fourth gear set and adapted to drive said fourth gear set in response to power applied to said second floating shaft as received by said sixth gear set; and wherein said second rail axle drives said rail car in response to power applied to said sixth gear set.

8. Apparatus as set forth in claim 7, wherein said fourth gear set on said second rail axle on said second bogie comprises at least two driven gears.

9. Apparatus as set forth in claim 8, wherein said fifth gear set on said second floating shaft comprises two driving gears, and wherein said fourth gear set and said fifth gear set are configured for meshing engagement.

10. Apparatus as set forth in claim 9, wherein said sixth gear set on said second floating shaft comprises two gears, and wherein said sixth gear set is configured to receive power and drive said second floating shaft and said fifth gear set.

11. Apparatus as set forth in claim 3, wherein said apparatus is further characterized in that the mount for the first floating shaft provides a pivotable connection to said first bogie which allows said first gear set to connect with said second gear set while allowing relative movement of the first gear set with said second gear set, as well as vertical movement of the deck of the rail car with respect to the first rail axle.

12. Apparatus as set forth in claim 7, wherein said apparatus is further characterized in that the mount for the second floating shaft provides a pivotable connection to said second bogie which allows said fourth gear set to connect with said fifth gear set while allowing relative movement of the fourth gear set with said fifth gear set, as well as vertical movement of the deck of the rail car with respect to the second rail axle.

13. Apparatus as set forth in claim 3, further comprising:

a first over-the-road tractor, said first over-the-road tractor comprising an engine, a transmission, a first drive axle, said first drive axle further comprising first and second sets of dual wheels on opposing sides of said first drive axle;

first and second external rail driving gears, said first external rail driving gear disposed between said first set of dual wheels and recessed sufficiently that said first external rail driving gear avoids ground contact during highway operations, and said second external rail driving gear disposed between said second set of dual wheels and recessed sufficiently that said second rail driving gear avoids ground contact during highway operations; and wherein said deck includes apertures therein sized and shaped to accommodate therethrough said first and second sets of dual wheels, so that when said first over-the-road tractor is placed on said deck, said first and second external rail driving gears are located in meshing engagement with said a first gear system for supply of motive power thereto from said engine of said first over-the-road tractor.

14. Apparatus as set forth in claim 13, further comprising:

a second over-the-road tractor, said second over-the-road tractor comprising an engine, a transmission, a second drive axle, said second drive axle configured for propelling third and fourth sets of dual wheels on opposing sides of said second drive axle, and third and fourth external rail driving gears, said third external rail driving gear disposed between said third set of dual wheels and recessed sufficiently that said third external rail driving gear avoids ground contact during highway operations, and said fourth external rail driving gear disposed between said fourth set of dual wheels and recessed sufficiently that said fourth rail driving gear avoids ground contact during highway operations.

wherein said rail car further comprises a second gear system, said second gear system comprising a plurality of gears configured to receive motive power supplied from third and fourth external rail driving gears on said second over-the-road tractor, and wherein said one or more external rail driving gears are located above said second pair of flanged main rail wheels; and wherein said deck includes apertures therein sized and shaped to accommodate therethrough said third and fourth sets of dual wheels, so that when said over-the-road tractor is placed on said deck, said third and fourth external rail driving gears are located in meshing engagement with said second gear system for supply of motive power thereto from said second over-the-road tractor engine.

15. A method for intermodal transport of goods by rail, comprising:

providing a rail car as set forth in claim 3;

providing one or more over-the-road tractors, said one or more over-the-road tractors configured for providing power to a rail axle on a bogie supporting said rail car;

providing one or more freight cars;

coupling said one or more freight cars to said rail car; and pulling said one or more freight cars using power provided by said one or more over the road tractors to said rail car.

16. The method as set forth in claim 15, wherein the freight cars are configured to carry over-the-road trailers, and wherein said over-the-road trailers are organized by specified final destination and placed on said one or more freight cars, and wherein said over-the-road trailers are removed from said freight cars at a rail yard, and wherein said over-the-road tractor delivers the over-the-road trailers to a specified final destination.

* * * * *